US007549304B2

(12) United States Patent
Jürgens et al.

(10) Patent No.: US 7,549,304 B2
(45) Date of Patent: Jun. 23, 2009

(54) KNITTING NEEDLE AND BAR FOR SAID NEEDLE

(75) Inventors: Eric Jürgens, Bisingen (DE); Torsten Butz, Messstetten (DE); Klaus Kirchmair, Nusplingen (DE); Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 233 days.

(21) Appl. No.: 11/655,996

(22) Filed: Jan. 22, 2007

(65) Prior Publication Data

US 2007/0169518 A1 Jul. 26, 2007

(30) Foreign Application Priority Data

Jan. 25, 2006 (EP) ..... 06001512

(51) Int. Cl.
*D04B 23/00* (2006.01)

(52) U.S. Cl. ..... 66/207; 66/208

(58) Field of Classification Search ..... 66/207, 66/208, 116

See application file for complete search history.

(56) References Cited

U.S. PATENT DOCUMENTS 2,266,112 A * 12/1941 Wirth ..... 66/206
2,682,163 A * 6/1954 Staff et al. ..... 66/208
3,823,581 A * 7/1974 Russo ..... 66/208
4,643,004 A * 2/1987 Wunner ..... 66/208
4,665,717 A * 5/1987 Atsushi ..... 66/208
5,233,846 A 8/1993 Seta et al.
5,373,710 A 12/1994 Roth
5,666,826 A * 9/1997 Mista ..... 66/114
6,151,929 A * 11/2000 Mista ..... 66/207

FOREIGN PATENT DOCUMENTS

| | | |
|---|---|---|
| DE | 103 35 464 A1 | 3/2005 |
| DE | 103 48 557 B3 | 6/2005 |
| EP | 0 596 245 A1 | 5/1994 |
| EP | 0 997 566 A2 | 5/2000 |
| GB | 2 134 142 A | 8/1984 |
| JP | 52-72657 | 5/1977 |
| JP | 01-43418 | 12/1989 |
| JP | 5005256 | 1/1993 |
| JP | 2951756 | 7/1999 |

* cited by examiner

*Primary Examiner*—Danny Worrell
(74) *Attorney, Agent, or Firm*—Fitch, Even, Tabin & Flannery; Norman N. Kunitz

(57) ABSTRACT

The inventive knitting tools, in particular knitting needles (6), have a body (7) which, for alignment, has on its narrow side projections (15, 16) which have precisely machined abutment surfaces (18, 19) on their end faces. The abutment surfaces (18, 19), can be produced, for example, during a suitable stage of the manufacturing process. One of the projections (15, 16) or an additional projection (17) can be provided with abutment surfaces (20, 21) which are used for longitudinal positioning of the knitting tool. Corresponding grooves (25, 26, 27) in the needle bar (1) are assigned to the projections (15, 16, 17).

17 Claims, 4 Drawing Sheets

KNITTING NEEDLE AND BAR FOR SAID NEEDLE

CROSS REFERENCE TO RELATED APPLICATION

This application claims the priority of European Patent Application No. 06 001 512.0, filed on Jan. 25, 2006, the subject matter of which, in its entirety, is incorporated herein by reference.

BACKGROUND OF THE INVENTION

The invention relates to a knitting needle and to a sinker bar to receive such a needle.

Warp knitting machines comprise several bars which support knitting tools or loop-forming tools such as apertured needles, hooked needles configured as compound needles, or sliders. In so doing, each of the bars forms a long support extending transversely to the direction of movement of the flat, knitted textile product, whereby these supports hold the appropriate knitting tools or loop-forming tools and can be moved consistent with the knitting or loop-forming process. As a result of this, all the knitting tools of a bar are moved fully synchronized with respect to each other. In so doing, the knitting tools of the different bars are moved relative to each other. In order to produce uniformly knitted products, it is important that the knitting tools or loop-forming tools held on the needle bar be precisely positioned. For example, warp knitting machines comprising knitting needles (compound needles) associated with sliders are known. The sliders are held on another bar and are used to open or to close the interior hook spaces of the knitting needles. To do so, the sliders and the compound needles must be positioned very precisely relative to each other. This requires that the knitting needles be held exactly aligned in the needle bar. This makes extreme demands on the manufacture of the knitting needles, as well on the manufacture of the bar, which means that manufacturing is considerably expensive and complex.

Considering this, the object of the invention is to design the knitting needle, and possibly also the bar of a knitting machine, in such a manner that high positioning precision of the respective knitting tool can be achieved at low manufacturing cost and effort.

SUMMARY OF THE INVENTION

The above object is generally achieved according to a first aspect of the present invention with a knitting tool having a flat body provided for the accommodation in a groove of a bar of a holding device, with the body having at least one narrow side on which at least two projections are arranged, and with each of the projections being provided with an abutment surface on its side facing away from the body for engaging a support surface within a respective groove of the bar.

The above object is generally achieved according to a second aspect of the present invention with a bar for supporting a series of knitting tool according to the invention, with the bar having: an upper surface provided with a series of grooves that are parallel to each other for the accommodation of the knitting tools; and at least first and second parallel grooves intersecting the series of grooves provided for the accommodation of the knitting needles, and being at least slightly deeper than the series of grooves.

In order to connect the inventive knitting tool to the bar, said tool has a shaft with at least one narrow side where two projections are arranged at a distance from each other. These projections extend away from the shaft and have an abutment surface on their face away from the shaft. This abutment surface is used to position the knitting tool on the bar. Considering the bar, the remaining narrow side is configured in such a manner that it does not abut against the bar. If the knitting tool is arranged in a groove, the narrow side does not abut against the groove bottom, but maintains a distance of, for example, a few tenths of a millimeter, therefrom. In so doing, the distance is dimensioned such that the manufacturing tolerances are of no consequence for positioning the knitting tool from the viewpoint of the straightness or the dimensional stability of the narrow side or from the viewpoint of the straightness or the dimensional stability of the groove bottom. Consequently, considering the knitting tool, the manufacturing costs and efforts can be substantially reduced. For example, different process operations for fine-machining and/or for calibrating the knitting tool with respect to the projections can be restricted—strictly speaking—to the faces of said projections. Thus, a gain in manufacturing safety and a reduction of the manufacturing costs and effort is achieved with the inventive knitting tools, even considering only conventional needle bars that have a straight and continuous groove bottom.

Another improvement in the sense of the aforementioned object is achieved when the knitting tools in according to the invention are mounted in the bar in accordance with the invention. This bar comprises a plurality of grooves arranged parallel to each other in order to accommodate the knitting tools, whereby the grooves can be machined into the bar by means of a side milling cutter, for example. Each of the grooves has a width of only 0.4 mm, for example.

The plurality of parallel grooves that act to accommodate the knitting tools are now traversed by two wider grooves that are parallel to each other and extend along the longitudinal direction of the needle bar. These latter grooves are preferably at right angles relative to the remaining narrower grooves. These two transversely extending grooves have a width of 3 mm, for example. In so doing, they are slightly deeper than the first-mentioned narrow grooves that accommodate the knitting tools. They can be milled continuously in one run, whereby their groove bottom forms the abutment surface or reference surface for the projections of the knitting tools. Due to the expected reduced tool wear of the wider groove miller, the shorter path traveled by said miller along the needle bar, and due to the circumstance that the two transverse grooves can be milled in one run, high machining accuracy can be achieved in a simple manner. The reliable depth tolerance of the grooves used to accommodate the knitting tools can thus be selected to be even greater, without developing any disadvantages from the viewpoint of the positioning accuracy of the knitting tools.

The projections that extend from the body of the knitting tools and are used for positioning, preferably are slightly larger than the difference of depth between the grooves intended for accommodating the knitting tools and the slightly deeper grooves that are arranged in a direction transverse thereto. Consequently, it is ensured that the narrow side of the knitting tool does not contact the bottom of its groove, i.e., not even when the depth of the receiving groove varies noticeably due to higher manufacturing tolerances.

Advantageous embodiments of the invention are characterized by subordinate claims. For example, the invention can be directly implemented on a needle bar or even on support or holding elements or on holding devices, which, in turn, are supported by another machine element, such as, for example, a bar. Such holding devices can have more or less long bar segments, modules, parts supports or the like. Preferably, however, the inventive idea is directly implemented on the needle bar itself.

Preferably, the knitting tool is designed as a knitting needle or as a hooked needle in that it is provided with a hook on one end. Considering the high positioning accuracy that is to be achieved with minimal manufacturing costs and efforts, this hooked needle is recommended for the cooperation with sliders. To this extent, the hooked needles may also be referred to as compound needles, even though the sliders are supported by another bar. The knitting tool, however, may also be another tool.

Preferably, referring to the inventive knitting tool, the narrow side is provided with projections and has an essentially straight form. However, the narrow side need not be subjected to any fine-machining; it is sufficient if such fine-machining is confined to the projections that are used for positioning.

For example, the abutment surfaces of the projections may have a slightly rounded or spherical form. Referring to a preferred embodiment, however, these abutment surfaces are configured as flat surfaces on the face side, whereby said flat surfaces are preferably also located on a common plane. In this way, even with high clamping forces acting on the knitting tools, a tolerable areal compression results on the corresponding abutment surfaces, so that indentations on and other damage to the knitting tool, or to the associate surfaces of the bar, are not to be expected.

Preferably, the knitting tool is a thin piece of sheet metal with two flat sides parallel to each other and with two narrow sides, whereby the distance between the flat sides, i.e., the thickness of the knitting tool, is only 0.4 mm, for example. The flat sides abut against the flanks of the groove provided on the bar, thus providing lateral positioning for the knitting tool. While the positioning of height and depth is performed by the projections, another projection, for example in the form of a foot coming into engagement with the deeper groove of the bar, may be provided for longitudinal positioning. In so doing, the abutment surfaces provided on the foot are at an angle preferably at a right angle with respect to the abutment surfaces of the projections.

It is possible to provide the foot, in addition to the two mentioned projections. However, it is also possible to structurally combine one of the projections with the foot. In this case, the affected projection has, on its face (parallel to the narrow side), an abutment surface for height positioning and, on its front and read edges, abutment surfaces which are oriented at a right or approximately right angle and are used for the longitudinal positioning of the knitting tool.

Details of the advantageous embodiments of the invention are obvious from the drawing, the description or the claims. The drawings show an exemplary embodiment of the invention.

DETAILED DESCRIPTION OF THE INVENTION

Figure 1:
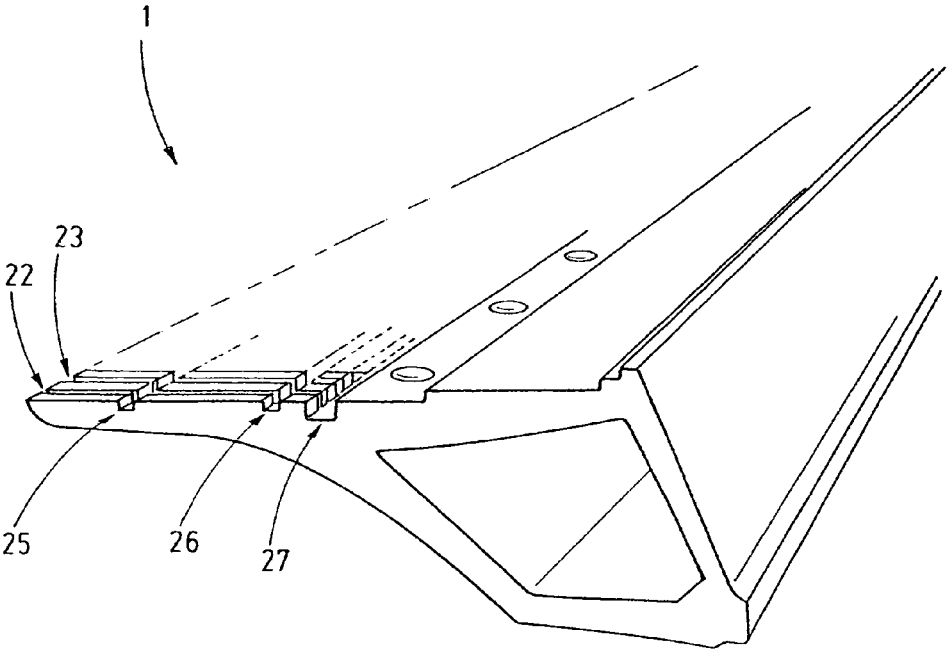
FIG. 1 is a perspective schematic illustration of a needle bar in accordance with the invention.

FIG. 1 shows a needle bar 1 which belongs to the knitting system 2 of a warp knitting machine. The knitting system 2 comprises several holding devices configured as bars, which include the needle bar 1, a slider bar 3 and, preferably, several apertured needle bars that hold apertured needles 4 and are not shown here. The slider bar 3 is provided with sliders 5, and the needle bar 1 is provided with knitting needles 6. Together, the knitting needles 6, the sliders 5 and the apertured needles 4 form knitting tools that are held in large numbers at uniform distances parallel to each other. In so doing, each knitting needle 6 is associated with exactly one slider 5 which must precisely interact with the knitting needle 6, which is why the knitting needle 6 and the slider 5 must be positioned precisely relative to each other.

Figure 3:
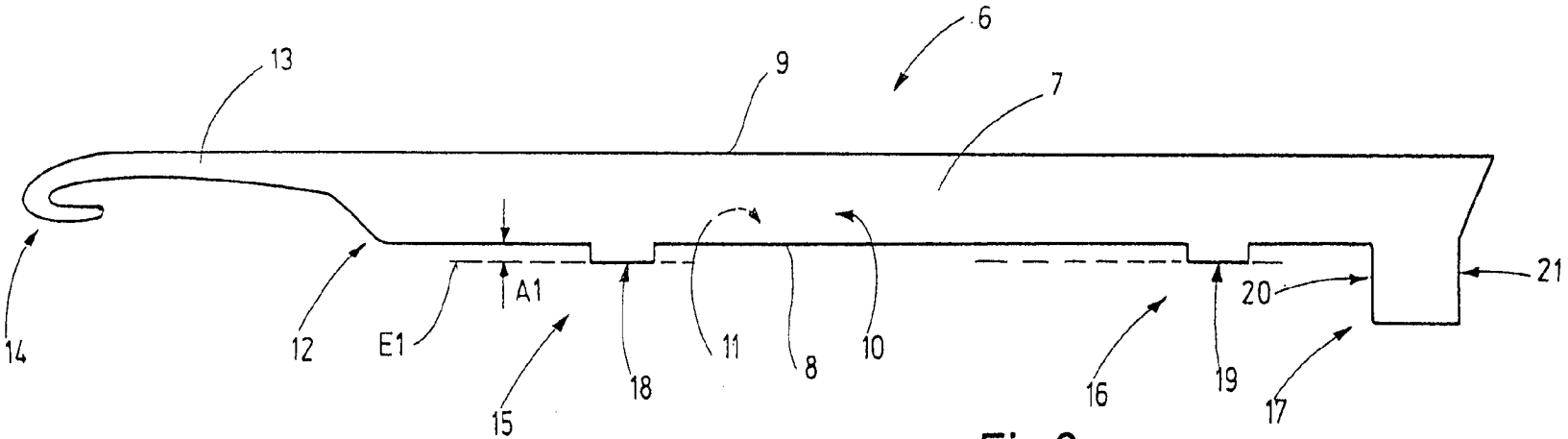
FIG. 3 is a separate illustration, drawn to a different scale, of a compound needle in accordance with FIG. 2.

FIG. 3 is a separate illustration of the knitting needle 6. This needle has a body 7 which is configured as a thin sheet metal part. To do so, the body 7 has two narrow sides 8, 9, as well as two flat sides 10, 11, which define a rectangular cross-section. The narrow sides 8, 9 and the flat sides 10, 11 are formed by flat surfaces and have an essentially straight configuration. On its one end, the longitudinal body 7 tapers, i.e., the distance between the narrow sides 8, 9 becomes smaller, for example, beginning at a step 12. The adjoining hook neck 13 has a hook 14 which preferably points to the step 12.

On the same side of the body 7, i.e., preferably on the narrow side 8, at least two projections 15, 16 and, optionally, a third projection 17 are provided, said projections being used for positioning the knitting needle 6. Viewed from the side, the projections 15, 16 have a trapezoidal or rectangular configuration, for example, whereby they, as illustrated, may be stepped or, alternatively, may also be rounded in order to be able to graduate into the narrow side 8. On their faces pointing away from the narrow side 8, the projections 15, 16 are provided with abutment surfaces 18, 19, which, preferably, can also be configured as flat surfaces. However, these surfaces may also be slightly rounded in order to have an axis extending along or transverse to the body 7. The flat configuration of the abutment surface 18, 19 is preferred, however, because of the type of area-covering transmission of force that is achieved between the knitting needle 6 and the needle bar 2.

The height of the projections 15, 16, i.e., the distance A1 between the abutment surfaces 18, 19 (containing the plane E1) and the narrow side 8 is preferably a few tenths of a millimeter and is substantially smaller than the length of the projections 15, 16 parallel to the narrow side 8 that is to be measured, said length being, e.g., two or three millimeters.

The circumstances are different in the case of the projection 17 which is designed as a foot, and which projects more than several millimeters beyond the narrow side 8, as well as beyond the plane E1. The projection 17 has a rectangular or trapezoidal contour. On its side facing the hook 14 and on its side facing away from the hook 14, this projection 17 has respective abutment surfaces 20, 21 which are used for positioning the knitting needle 6 in longitudinal direction. The abutment surfaces 20, 21 are preferably oriented parallel to each other. Furthermore, it is possible to arrange the abutment surfaces 20, 21 at an angle with respect to the narrow side 8, said angle not being a right angle.

Figure 2:
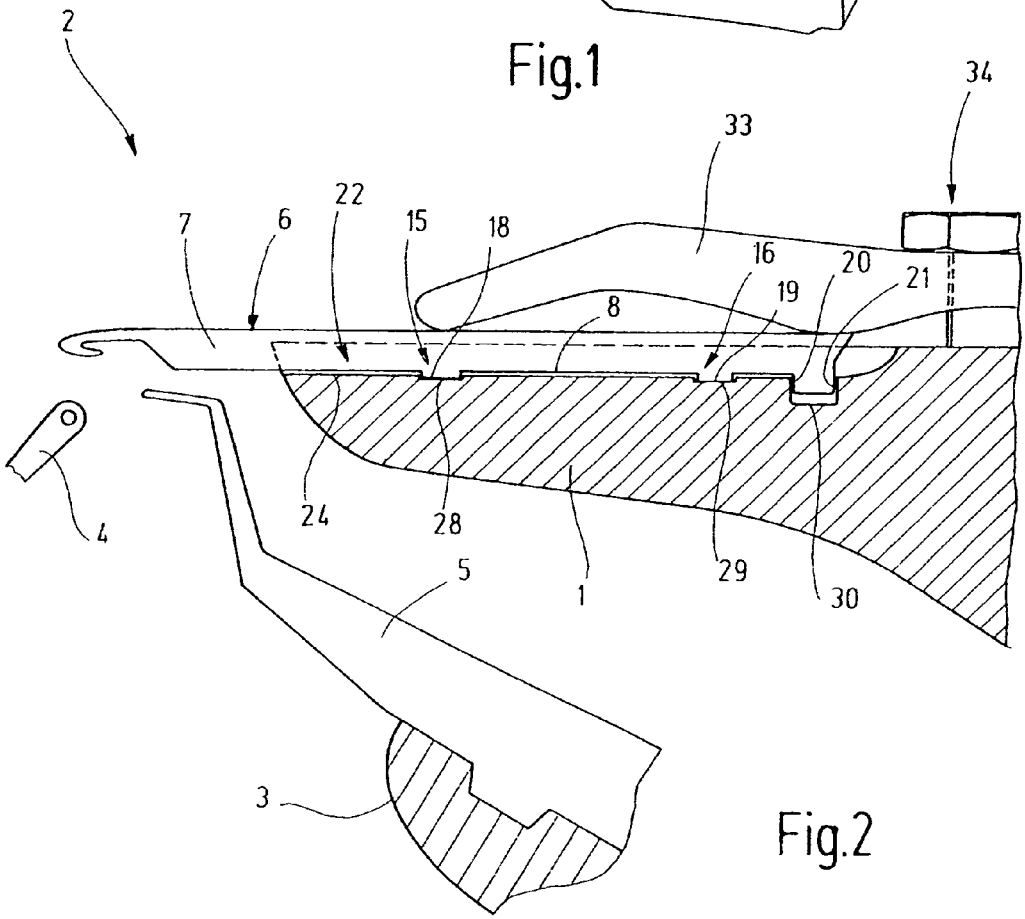
FIG. 2 is a schematic sectional illustration of the needle bar in accordance with FIG. 1, with the inventive knitting tool designed as a compound needle with its associate slider held by its own bar.
Figure 4:
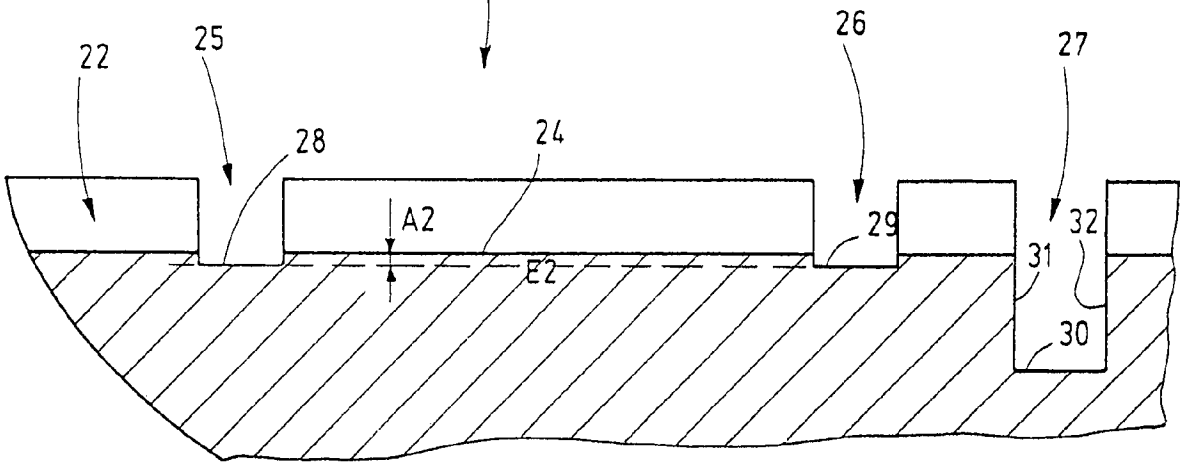
FIG. 4 is a separate illustration, drawn to a different scale, of the needle bar in accordance with FIG. 2.
Figure 5:
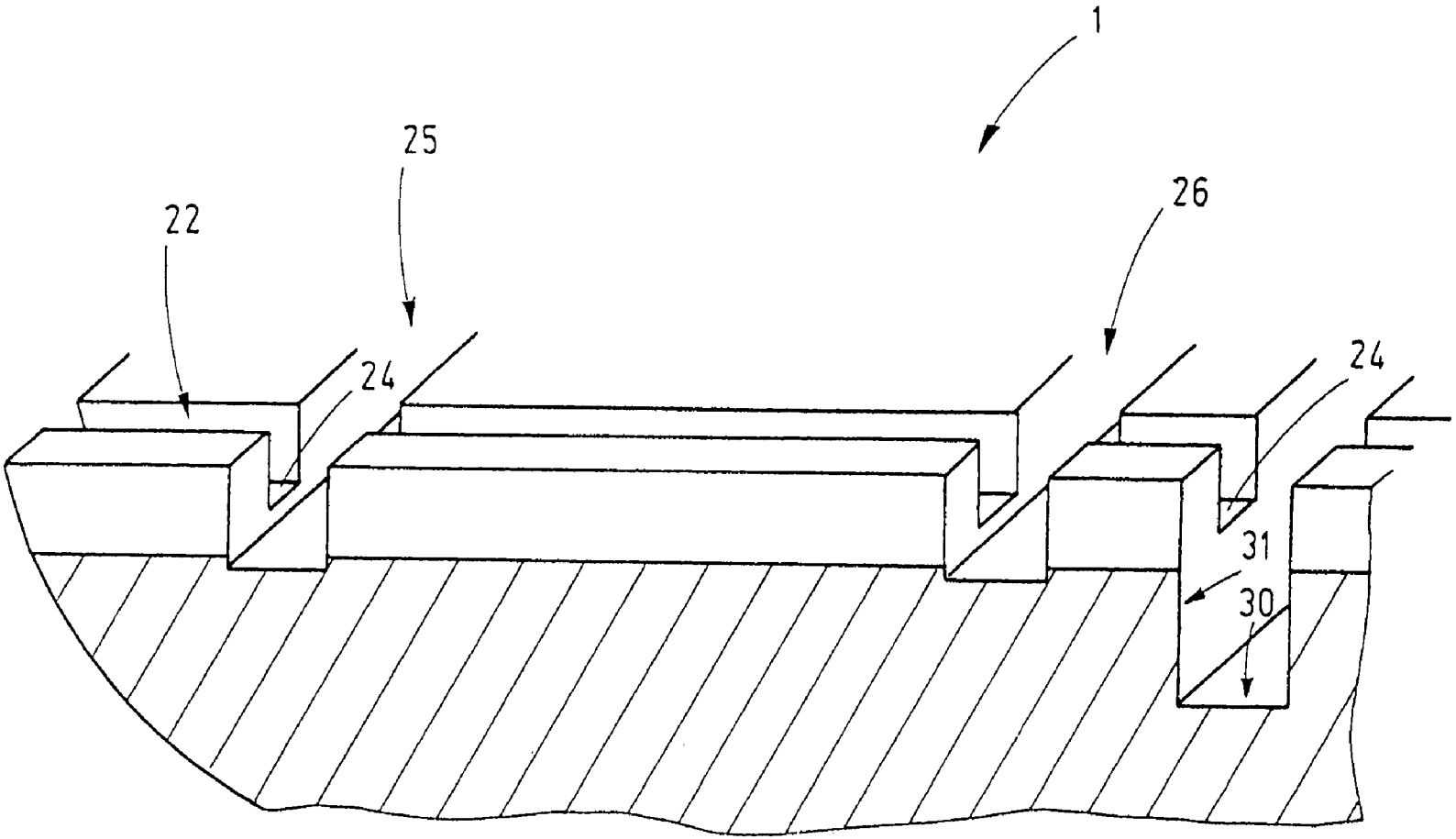
FIG. 5 is a sectional perspective illustration of the needle bar in accordance with FIG. 4, for further explanation.

FIG. 4 shows the needle bar 1 that acts as a bed for the stationary accommodation of the knitting needles 6. As is obvious from FIG. 1, this bar has a number of grooves 22, 23, which are oriented parallel to each other and which have widths that are slightly greater than the distance between the flat sides 10, 11 of each knitting needle 6. Therefore, the knitting needles 6 fit somewhat smoothly, yet still without feelable play, into the grooves 22, 23, etc. The grooves 22, 23, for example, have been produced by means of a side milling cutter. As is obvious from FIGS. 2 through 5, these grooves have an essentially flat bottom 24 and laterally flat flanks. The group of the grooves 22, 23, which act to receive the knitting tools, for example, the knitting needles 6, is traversed by two grooves 25, 26, which are parallel to each other and, optionally, by a third groove 27, which intersect the grooves 22, 23 at right angles. As is obvious from FIG. 4, in particular, the first and the second grooves 25, 26 are slightly deeper than the grooves 22, 23. As a result of this, the bottoms 28, 29 of the grooves 25, 26 are located slightly below the bottom 24 of the groove 22. Correspondingly, this applies to all other grooves 23, etc. which act to receive the knitting tools. In so doing, the distance A2 of the bottom 24 from the bottoms 28, 29, which are preferably located on a common plane E2, is preferably slightly smaller than the distance A1. As can be seen in FIG. 2, the difference between the distances A1 and A2 produces a distance between the narrow side 8 and the bottom 24 having the configuration of a slight gap when the abutment surfaces 18, 19 abut against the bottoms 28, 29 of the grooves 25, 26. The difference between the distances A1 and A2 allows an appropriately large tolerance with regard to the depth of the groove 22. Consequently, the grooves 25, 26 are used for the precise positioning of the knitting needle 6, or of any other knitting tool, with respect to the vertical direction as in FIG. 2, 3 or 4. Considering the horizontal direction, which corresponds to the longitudinal direction of the knitting needle 6, the grooves 25, 26, or the projections 15, 16, however, preferably do not initiate any positioning effect. This is achieved in that the length of the projections 15, 16 that is to be measured transverse to the groove 25, 26, or alongside the knitting needle 6, is dimensioned significantly smaller than the widths of the grooves 25, 26. Consequently, longitudinal positioning is effected only by the foot or by the projection 17. The latter is assigned to the groove 27 (FIG. 4), said groove being substantially deeper than the grooves 25, 26. Their bottom 30 is located clearly below the plane E2 and, if the knitting needle 6 is inserted into the groove 22, is at a distance from the face of the projection 17 (see FIG. 2).

While, in the case of the grooves 25, 26, the bottoms 28, 29 form the reference surfaces for positioning the knitting needle 6, it is the two flanks 31, 32 which act as reference surfaces or positioning surfaces in the case of the groove 27. The flanks 31, 32 that are oriented parallel to each other are positioned, e.g., at a right angle, relative to the plane E2. Alternatively, however, these flanks may also subtend an acute angle, whereby, preferably, the angle subtended by the abutment surfaces 20, 21 corresponds to the angle subtended by the flanks 31, 32.

In order to manufacture the needle bar 1, several grooves 22, 23, e.g., 6000 per bar, as well as the grooves 25 through 27, are produced by mechanical means. The grooves 22, 23 are applied individually or in sets (one set contains several individual grooves) with one groove being applied after the other; thus, an individual manufacturing step is required for each groove 22, 23, etc. This procedure results in a spreading of the distances of the bottoms 24 or the individual grooves 22, 23 relative to each other, thereby affecting the prior art knitting tools, i.e., with respect to their vertical position relative to each other.

The grooves 25, 26, 27 can be produced in one run parallel to the longitudinal direction along the entire length of the needle bar 1. This can be done before or after the production of the grooves 22, 23, etc., that extend in a direction transverse thereto. Consequently, the bottoms 28, 29, which represent a reference surface for the vertical position for all knitting needles 6, as well as also the flanks 31, 32, which also form the reference surfaces for the horizontal position, are produced in one process cycle without interruption. This ensures an alignment of the knitting needles 6 relative to each other, said alignment being subject to no or only to minimal spreading. The abutment surfaces 18, 19 of all knitting needles 6 contact the same reference surfaces 28, 29. Therefore, said knitting needles are also optimally aligned with respect to each other and to the sliders 5 when the bottom 24 of each groove 22, 23, etc., is manufactured with greater tolerance. It is only essential that the distance A2 (FIG. 4) be substantially smaller than the distance A1 (FIG. 3), whereby the difference between the distances is greater than the tolerance of the depth of the groove 22, 23, etc.

Figure 6:
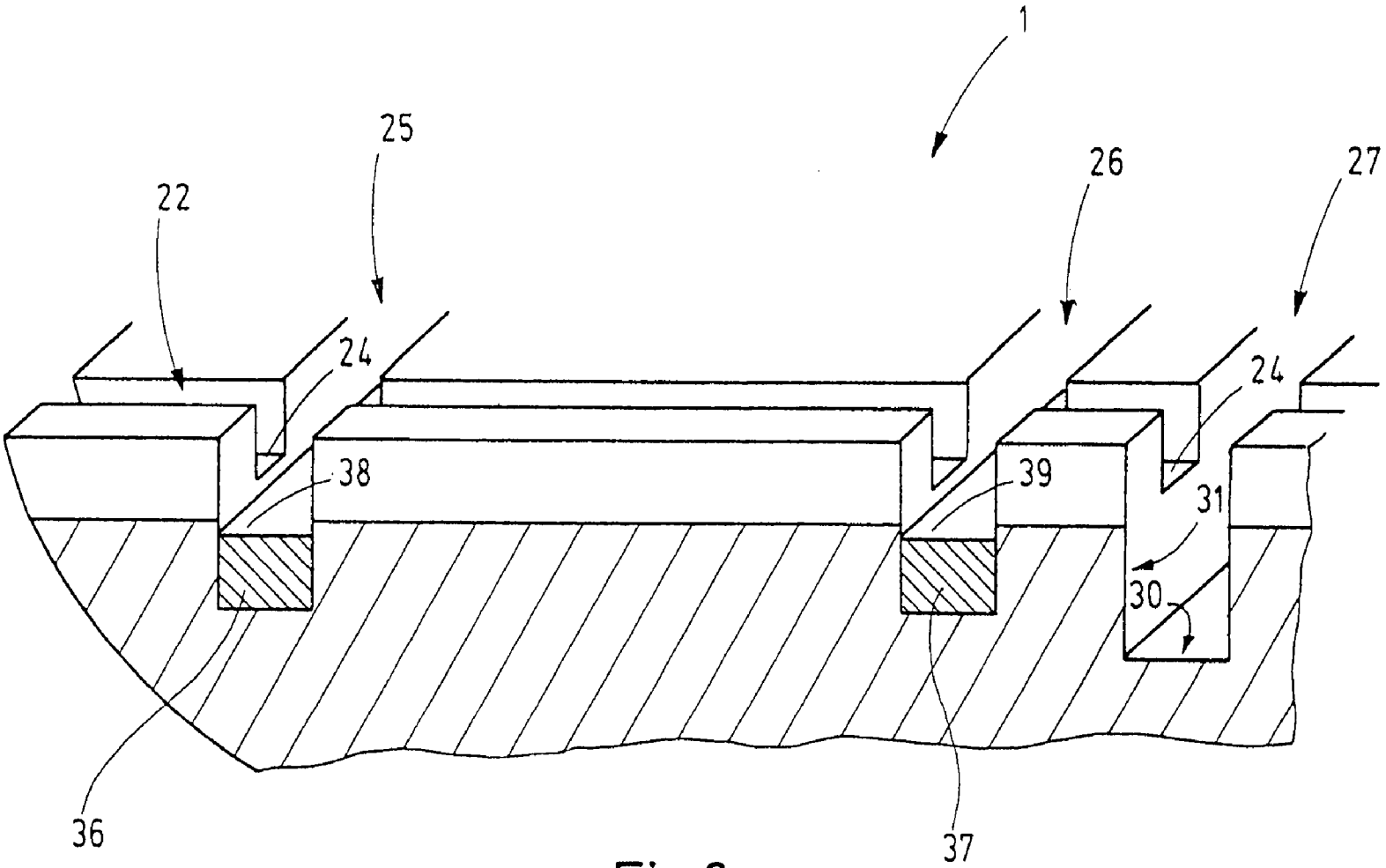
FIG. 6 is a sectional perspective illustration of a modified embodiment of the needle bar in accordance with FIG. 4, for further explanation.

Another modified embodiment of the holding device 1 (FIG. 6) consists in that the grooves 25 through 27 represent continuous cutouts having a depth that is greater than the height A1 of the projections 15, 16. These cutouts do not have bottoms 28, 29. In order to achieve the vertical alignment and to determine the vertical position of the knitting tools 6 in this case, the support means 36, 37 with support surfaces 38, 39 are used to take over the function of the bottoms 28, 29. Then, the abutment surfaces 18, 19 of the projections 15, 16 of the knitting needles 6 abut against the support surfaces 38, 39 of the support means 36, 37. These support means 36, 37 may be designed in the form of ledges that extend across the length of the needle bar 1 and parallel thereto. Said support means are detachably mounted to the needle bar 1 by known mounting means. Alternatively, the support means 36, 37 may also be permanently connected to the needle bar 1.

By separating the function of the vertical position of the knitting needles 6 from the needle bar 1, the manufacture of said bar is made easier. The manufacturing process of the needle bar 1 then requires only the alignment of the knitting tools in a direction transverse to the longitudinal direction of the needle bar 1. Mechanical manufacturing processes in accordance with prior art can then be used as regards the depth tolerances of the grooves 25, 26. The vertical alignment is achieved by the support means.

As is obvious from FIG. 2, one or several clamp claws 33 are used to mount the knitting needle 6 to the needle bar 1. These clamp claws are clamped in place by means of appropriate mounting means 34. The clamp claws 33 push against the narrow side 9 and thus push the abutment surfaces 18, 19 against the bottoms 28, 29. Preferably, the clamp claws 33 are configured in such a manner that pressure is exerted on the knitting needle 6, in particular, in the region of the projections 15, 16.

The inventive knitting tools, in particular the knitting needles 6, have a body 7 which, for alignment, is provided on its narrow side with projections 15, 16 that have precisely machined abutment surfaces 18, 19 on their end faces. The abutment surfaces 18, 19 can be manufactured during a suitable stage of the manufacturing process. One of the projections 15, 16, or an additional projection 17, can be provided with abutment surfaces 20, 21 that are used for the longitudinal positioning of the knitting tool 6. The projections 15, 16, 17 are associated with corresponding grooves 25, 26, 27 in the needle bar 1.

List of Reference Numbers

| | |
|---|---|
| 1 | needle bar, holding device |
| 2 | knitting system |
| 3 | slider bar |
| 4 | apertured needle (not illustrated) |
| 5 | slide |
| 6 | knitting needles |
| 7 | body |
| 8, 9 | narrow sides |
| 10, 11 | flat sides |
| 12 | step |
| 13 | hook neck |
| 14 | hook |
| 15, 16, 17 | projections |
| 18, 19, 20, 21 | abutment surfaces |
| 22, 23 | grooves |
| 24 | bottom |
| 25, 26, 27 | grooves |
| 28, 29, 30 | bottoms |
| 31, 32 | flanks |
| 33 | clamp claws |
| 34 | mounting means |
| A, A1, A2 | distance |
| E, E1, E2 | plane |

The invention claimed is:

1. Bar with a knitting tool, wherein: the knitting tool has a flat body having at least one narrow side on which at least two projections are arranged, with each of said projections being provided with an abutment surface on its side facing away from the body; the bar is provided on one side with a series of grooves that are parallel to each other for the accommodation of the knitting tools, and with at least a first and a second groove which intersect the series of grooves provided for the accommodation of the knitting tools, and which are at least slightly deeper than said series of grooves; and each of the first and the second grooves is positioned to receive a respective one of the at least two projections and has a bottom that represents a reference surface for engaging the respective abutment surface of the respective projection, with the at least two projections having a height, measured from the narrow side of the knitting tool, that is greater that the difference in depth between the series of grooves and the first and second grooves for positioning the knitting tools within the respective series of grooves in the vertical direction.

2. Bar in accordance with claim 1, wherein the first and second grooves have a width that is greater than the length of the associated projection, whereby said length is to be measured parallel to the narrow side of the knitting tool.

3. Bar in accordance with claim 1, wherein the bar has a third groove which intersects the series of grooves provided for the accommodation of the knitting tools, said third groove being at least deeper than the series of grooves.

4. Bar in accordance with claim 3, wherein the third groove has a width that corresponds to the length, measured parallel to the narrow side of the knitting tool, of a projection provided on the narrow side the knitting tool.

5. Bar in accordance with claim 1, wherein the first and second grooves are aligned parallel to each other.

6. Bar in accordance with claim 1, wherein each of the first and second grooves has a depth which is greater than the height of the projections from the narrow side and, for the alignment of the knitting tools in a vertical direction, at feast one support means is provided transverse to the bar within a groove of said series of grooves, whereby the knitting needles abut against said support means.

7. Bar in accordance with claim 6, wherein the support means have support surfaces which are in contact with the abutment surfaces of the projections of the knitting needles.

8. Bar in accordance with claim 6, wherein the support means are detachably connected with the bar.

9. A knitting tool for use in a bar that is provided on one side with a series of grooves that are parallel to each other for the accommodation of the knitting tools, and at least first and second parallel grooves intersecting the series of grooves provided for the accommodation of the knitting tools, wherein the knitting tool has a flat body that is provided for accommodation in one of said series of grooves of the bar, with said body having at least one narrow side surface on which at least two projections that extend outwardly from the side surface are arranged, with each of said projections being provided with an abutment surface on its side facing away from the body for engaging a bottom of one of the first and second grooves and being dimensioned such that a small gap will remain between the narrow side surface and a flat bottom of said one of the series of grooves when the needle is inserted into and secured in the one of the series of grooves.

10. Knitting tool having a flat body provided for the accommodation in a groove of a bar of a holding device, said body having at least one straight narrow side surface on which at least two projections that extend outwardly from said narrow side surface are arranged, each of said projections being provided with an abutment surface on its side facing away from the body for engaging a support surface within a respective groove of the bar to maintain said narrow side surface of said tool at a desired distance from a groove bottom.

11. Knitting tool in accordance with claim 10, wherein the tool is a knitting needle provided with a hook at one end.

12. Knitting tool in accordance with claim 10, wherein the abutment surfaces are located on a common plane (E1).

13. Knitting tool in accordance with claim 10, wherein each of the two abutment surfaces is respectively arranged parallel to the narrow side surface of the body.

14. Knitting tool in accordance with claim 10, wherein the longitudinal body has respectively two flat sides, with said flat sides being parallel to each other and adjoining the at least one narrow side surface, and has a further narrow side surface opposite the at least one narrow side surface, whereby the distance between the flat sides is distinctly smaller than the distance between the narrow side surfaces.

15. Knitting tool in accordance with claim 10, wherein at least one projection provided on said at least one narrow side surface has at least one abutment surface which is oriented at an angle with respect to the at least one narrow side surface.

16. Knitting tool in accordance with claim 15, wherein the projection having at least one abutment surface oriented at an angle with respect to the at least one narrow side surface, at the same time, forms one of the projections having an abutment surface on its side facing away from the body.

17. Knitting tool in accordance with claim 15, wherein the projection having an abutment surface oriented at an angle with respect to the at least one narrow side surface is arranged at a distance from the at least two projections having an abutment surface facing away from the at least one narrow side surface.

* * * * *